United States Patent [19]

Durin

[11] 4,063,871

[45] Dec. 20, 1977

[54] BOILER BURNERS

[75] Inventor: Michel Durin, Paris, France

[73] Assignee: Societe Anonyme Automobiles Citroen, Paris, France

[21] Appl. No.: 707,002

[22] Filed: July 20, 1976

[30] Foreign Application Priority Data

July 22, 1975 France ..... 75.22820

[51] Int. Cl.[2] ..... F23N 5/00

[52] U.S. Cl. ..... 431/89; 137/566; 431/4; 431/210; 431/37

[58] Field of Search ..... 431/2, 3, 4, 190, 89, 431/39, 210; 137/566, 94, 565

[56] References Cited

U.S. PATENT DOCUMENTS

| | | | |
|---|---|---|---|
| 2,618,935 | 11/1952 | Malir, Jr. | 431/39 X |
| 3,741,712 | 6/1973 | Delatronchette | 431/4 X |
| 3,766,942 | 10/1973 | Delatronchette et al. | 431/4 X |
| 3,837,784 | 9/1974 | Delatronchette | 431/4 |
| 3,958,915 | 5/1976 | Noda et al. | 431/4 X |

*Primary Examiner*—Edward G. Favors
*Attorney, Agent, or Firm*—Wenderoth, Lind & Ponack

[57] ABSTRACT

The present invention relates to installations for supplying the burners of boilers with an emulsion of fuel, water and if desired soluble oil, intended to ensure the elimination of 95% of the solid unburnt material in the combustion gases of boilers and hot air generators and to eliminate the liquid residues by incineration. The installation includes a reserve tank fed by an electrovalve controlled by a level-electrode provided in the tank so as to maintain a constant level of liquid, a pump, an emulsifying device and at least one burner, together with a regulating valve acting on the flow of liquid to be treated in dependence on the temperature of the mixture after its passage through the emulsifier, this valve being mounted between the pump and the emulsifier.

4 Claims, 2 Drawing Figures

BOILER BURNERS

BACKGROUND AND SUMMARY OF THE INVENTION

The present invention has for its object to provide an installation for supplying the burners of boilers with an emulsion of fuel, water and, if so desired, soluble oil. Such installation is intended to ensure the elimination of 95% of the solid unburnt material in the combustion gases of boilers and hot-air generators and to eliminate by incineration the liquid residues, the disposal of which is subject to regulations. In this way, atmospheric pollution is reduced and the cost involved by the return of the oil to an external company for the purpose of its treatment, is avoided. The frequency of sweeping the chimneys of the boilers is also reduced.

It has been determined by experience that at least 15% water is necessary in order to ensure the elimination of the solid unburnt material.

When it is a question of incinerating residues, the percentage varies between 25 and 40% as a function of the quantity of combustible products present in the residues.

The invention thus proposes to provide an installation and a method for the treatment of all the soluble oils and also of degreasing or phosphatizing baths of machines for washing mechanical parts.

The invention has more particularly for its object the provision of an installation intended to burn emulsions of the water-soluble oil - fuel type, such installation including reserve tank fed by an electro-valve controlled by a level-electrode provided in the tank in order to maintain a constant level of the liquid to be treated in the tank, at least one pump, an emulsifier and at least one burner. There is provided on the path between the pump and the emulsifying device, a regulating valve acting on the flow-rate of liquid to be treated as a function of the temperature of the mixture, detected after its passage through the emulsifier.

BRIEF DESCRIPTION OF THE DRAWINGS

The invention will be more clearly understood from the description which follows below of non-limiting embodiments of installations intended to burn water-soluble oil - fuel emulsions, reference being made to the accompanying drawings, in which.

DETAILED DESCRIPTION OF THE INVENTION

Figures 1, 2:
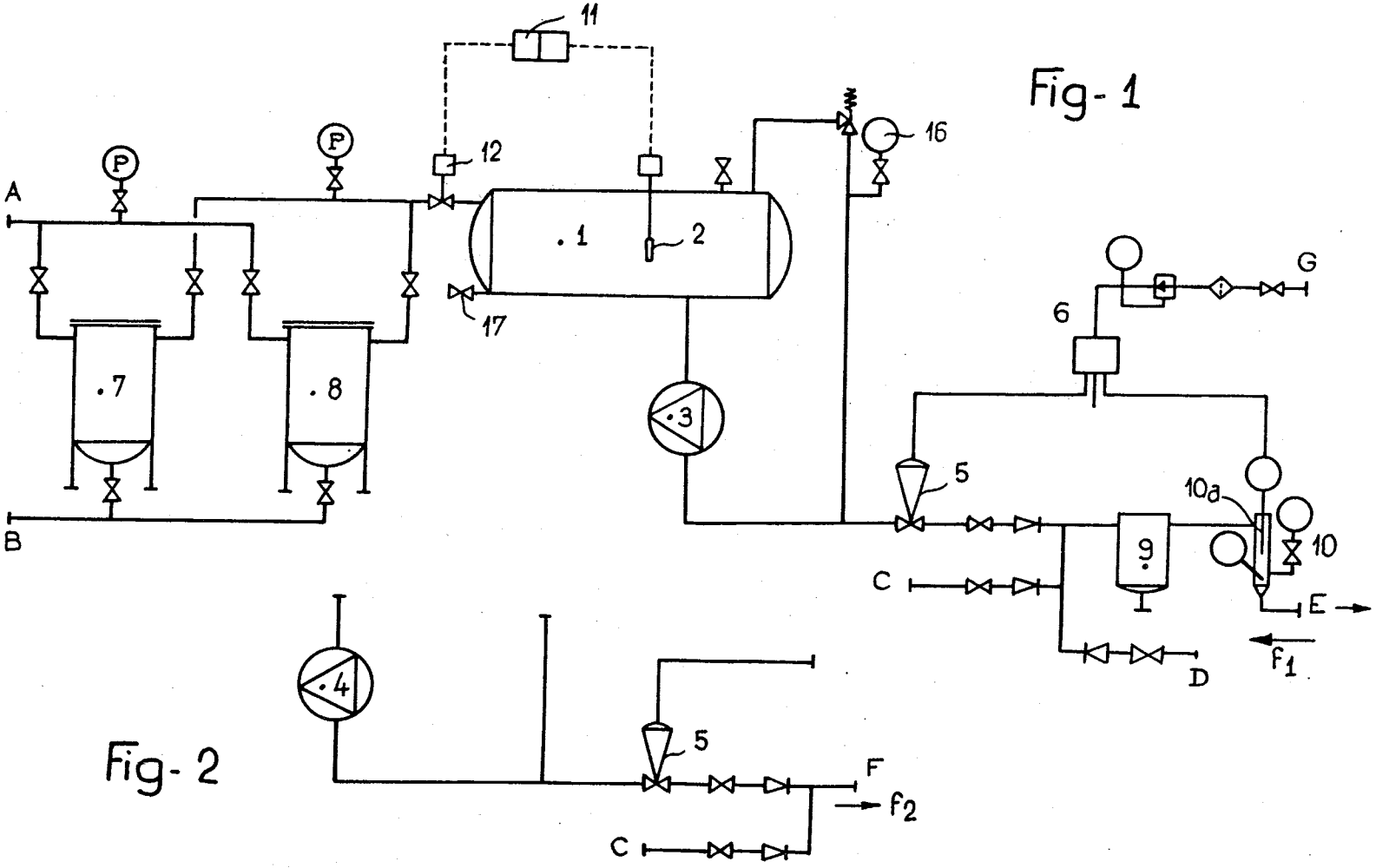
FIG. 1 is a diagrammatic view of an installation according to the invention, with a burner having a return flame.
FIG. 2 is a partial view of an installation according to the invention having a burner with no return flame.

In a reserve tank 1, containing liquid to be burned, there is provided a level electrode 2 which acts through the intermediary of a control box 11, on the regulating valve 12 which controls the passage of a liquid mixture comprising soluble oil. This mixture is introduced at A and passes through one of two metallic basket and candle filters 7 and, 8 mounted in parallel, with the other filter 7 or 8 serving as a stand-by.

In the case of an automatic burner with a return flame supplied with heavy oil and including a high-pressure pump at the burner and a return circuit, there has been provided in the installation at the outlet of the tank, a low-pressure pump 3 co-operating with a valve 16 for regulating the delivery of the pump. The mixture of soluble oil and/or water and heavy fuel is effected on the downstream side of a regulating valve 5. The heavy fuel and the return fuel from the burner are led into a mixing zone by the conduits C and D respectively.

Downstream of the mixing point of the various constituents is mounted an emulsifier 9. The valve 5 cooperates with a temperature regulator 10 located on the downstream side of the emulsifier 9 and equipped with a temperature measuring bulb 10*a*. The temperature data are transmitted to a receiving box 6 with bellows which controls the regulating valve 5 through the intermediary of a source G of compressed air. The regulation system can be adjusted for constant temperature ranges of the emulsified liquid. When the temperature of the liquid is located outside the range of regulation, this means that the ratio of the respective quantities of fuel and water has changed, and the regulating valve is acted upon in order to reestablish the correct percentage immediately.

In the case of a manually regulated burner without a return, the low-pressure pump 3 for the injection of soluble oil or water is replaced by a high-pressure pump 4 delivering directly through the regulation system and the emulsifier to the burner. The return conduit D serves no further purpose and the remainder of the installation comprises the same parts as in the case of burners with a return.

It is quite clear that the invention is not in any way limited by the specific structures described above with reference to the accompanying drawings, but that it includes all modifications and alternative forms within the knowledge of those skilled in the art, within the scope of the invention. Thus, other supply systems of burners may be provided, and the metallic basket and candle filters may only be installed in the cases of emulsions with soluble oil in order to avoid abrasion of the burner or burners by the metallic particles in suspension in the oil.

What we claim is:

1. An installation for burning emulsions of the water-fuel type, said installation comprising:

a reserve tank;

means for supplying water to said reserve tank;

at least one burner;

a conduit extending between said reserve tank and said burner;

at least one pump means in said conduit for pumping water from said reserve tank to said burner;

means for supplying fuel to said water in said conduit at a position between said pump means and said burner;

emulsifier means, positioned between said fuel supplying means and said burner, for forming an emulsion of said fuel and water;

temperature measuring means, positioned between said emulsifier means and said burner, for measuring the temperature of said emulsion after discharge thereof from said emulsifier means; and regulating valve means, positioned between said pump means and said fuel supplying means and controlled by said temperature measuring means, for controlling the amount of water passed to said emulsifier means as a function of the temperature of said emulsion after discharge thereof from said emulsifier means.

2. An installation as claimed in claim 1, further comprising means for supplying water soluble oil to said reserve tank, whereby said reserve tank contains a mixture of water and soluble oil, and said pump means pumps said mixture to said burner.

3. An installation as claimed in claim 1, wherein said burner comprises an automatic burner and a fuel return, said pump means comprises a low-pressure pump, and further comprises at least one high-pressure pump at said burner.

4. An installation as claimed in claim 1 wherein said burner comprises a manually controlled burner without a return, and said pump means comprises a high-pressure pump.

* * * * *